United States Patent [19]

Metzger

[11] 4,381,982

[45] May 3, 1983

[54] ROTOGRAVURE CYLINDER PLATING AND DE-PLATING APPARATUS

[75] Inventor: Hubert Metzger, Milwaukee, Wis.

[73] Assignee: Printing Machinery & Electronics, Inc., Milwaukee, Wis.

[21] Appl. No.: 367,151

[22] Filed: Apr. 13, 1982

Related U.S. Application Data

[63] Continuation-in-part of Ser. No. 255,281, Apr. 17, 1981, Pat. No. 4,352,727, which is a continuation-in-part of Ser. No. 211,562, Dec. 1, 1980, Pat. No. 4,331,527.

[51] Int. Cl.[3] ..... C25D 17/00; C25D 17/12

[52] U.S. Cl. ..... 204/212; 204/25; 204/272; 204/285

[58] Field of Search ..... 204/212, 285, 25, 272, 204/275

[56] References Cited

U.S. PATENT DOCUMENTS

| | | | |
|---|---|---|---|
| 1,381,882 | 6/1921 | Merritt | 204/212 |
| 1,792,998 | 2/1931 | Melish | 204/285 |

FOREIGN PATENT DOCUMENTS

| | | | |
|---|---|---|---|
| 2449735 | 4/1976 | Fed. Rep. of Germany | 204/212 |
| 715436 | 9/1954 | United Kingdom | 204/285 |
| 442236 | 9/1974 | U.S.S.R. | 204/13 |

*Primary Examiner*—T. M. Tufariello

*Attorney, Agent, or Firm*—Littlepage & Webner

[57] ABSTRACT

Polypropylene plastic baskets for phosphorized or non-phosphorized copper anode nuggets are suspended, one on each side of a cylinder to be plated, in a bath of plating electrolyte. The tops of the baskets are disposed beneath the surface of the plating solution, the upper portion of the cylinder is above the surface of the electrolyte, lead anode conductor strips extend downwardly along the insides of the rear walls of the baskets, and the front walls of the baskets are perforate.

After the cylinder is printed out, it is returned to the plating apparatus and reversely plated to remove the copper. In order to prevent the copper from building up through the perforations in the inner walls of the baskets and to keep reduced-size nuggets from protruding through the basket openings, a porous plastic sheet is disposed over the lower portion of the inner surface of the inner wall of each of the baskets. Between the baskets and the cylinder titanium screens are placed over the inner walls of the baskets and are in contact electrically with the lead anode conductor strips so that copper from the cylinder plates onto the screens.

7 Claims, 2 Drawing Figures

ROTOGRAVURE CYLINDER PLATING AND DE-PLATING APPARATUS

RELATED APPLICATION

Figure 1:
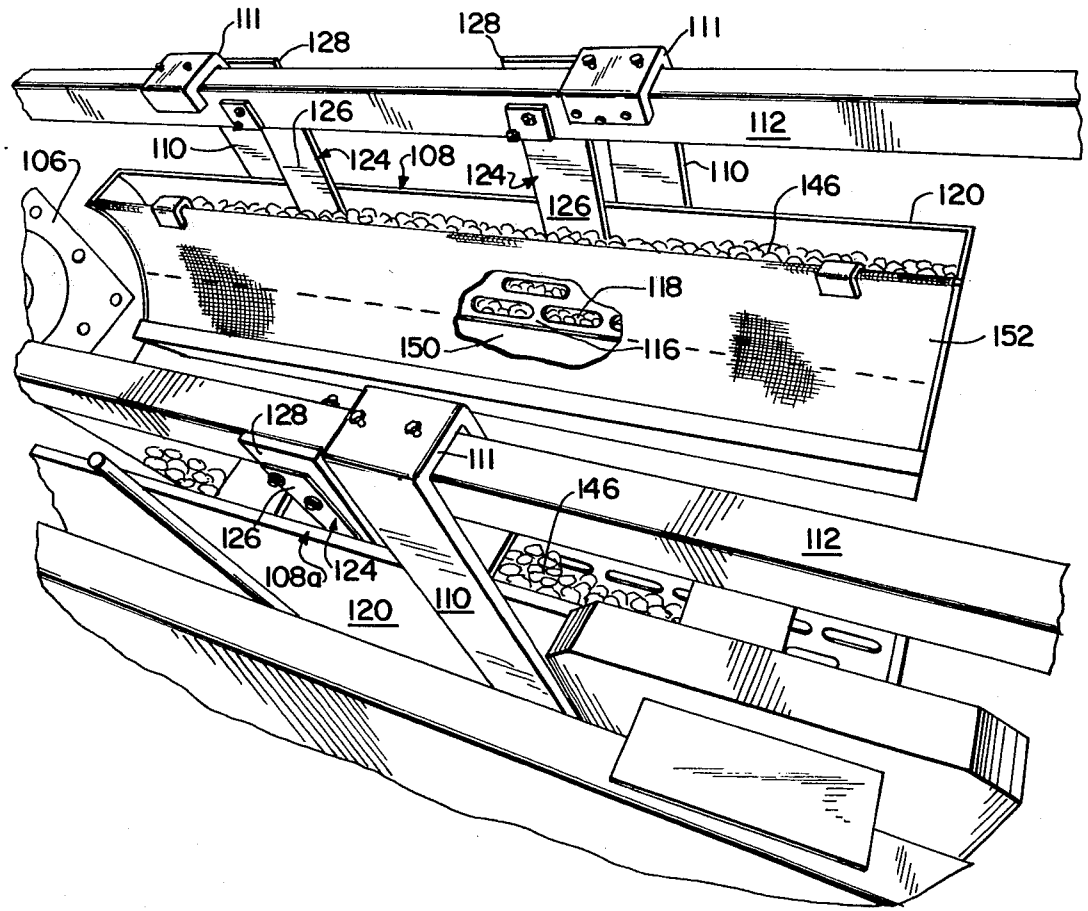

This is a continuation-in-part of co-pending U.S. application Metzger, Ser. No. 255,281, filed Apr. 17, 1981 now U.S. Pat. No. 4,352,727; which is a continuation-in-part of co-pending U.S. application Metzger, Ser. No. 211,562, filed Dec. 1, 1980 now U.S. Pat. No. 4,331,527.

FIELD OF INVENTION

Chemistry, electrical and wave energy, processes and products, coating, cylinders, rolls or hollow articles.

OBJECTS

In electroplating rotogravure cylinders, it is customary to rotate the cylinder, as a cathode, in a bath of electrolyte in which copper nuggets are supported in curved baskets disposed one on each side of the cylinder. Heretofore, the anode baskets typically were of titanium, which greatly limited the current-carrying capacity, and at spot contacts with the nuggets the titanium burned out.

The object of this invention is to provide concavo-convex baskets for the copper nuggets which are made of plastic, i.e., polypropylene, supported by non-current-carrying, protectively-coated hangers in the electrolyte bath. The concave or front walls of the baskets which face the cylinder are perforate, and curved lead anodes extend downwardly along the inner sides of the rear walls of the baskets and contact the copper nuggets. The copper nuggets, since they surround three sides of the lead anodes and are disposed between the lead anodes and the cylinder thus protect the lead anodes against wear-out; and the baskets, being of nonconductive plastic material, are not subject to burn out at "hot spots."

A further object is to provide a cylinder plating and deplating apparatus of the type described, in which the top of the rotating cylinder to be plated or deplated is disposed above the surface of the electrolyte so that a washing action occurs as the surface of the cylinder sweeps across the surface of the electrolyte; in which the tops of the baskets are disposed below the surface of the electrolyte so as to ensure free circulation of constantly-refreshed electrolyte; and in which the electrolyte is injected via a manifold into the bath at a location along the bottom of one basket which is less than 180° from the top of the cylinder, as measured in the direction of the cylinder rotation, the injection being in the direction of cylinder rotation. By this means, the electrolyte is entrained and carried along with the cylinder between the cylinder and the baskets thence against the top of the cylinder and over the baskets.

Heretofore, after the plated cylinder had been engraved and then printed out, the cylinder, with a "Ballard" shell on it, was moved to the plating department for stripping. However, instead of using a "Ballard" shell, some concerns simply use base copper on the cylinder; and when such a cylinder has been printed out, it is returned to the plating bath and reversely plated so as to return the engraved copper surface back to the copper nuggets in the baskets. The cylinder is made positive, the anode minus, and deplating ensues for whatever length of time is needed.

It is known in the electroplating process that better results are obtained by the utilization of anode material presenting a maximum amount of surface area to the action of the electrolyte in the plating process, the material acting as a cathode during the deplating process. In this invention the object of maximizing the surface area of the anode is carried out by the use of a titanium screen which covers the inner wall of each of the plastic baskets and overlaps the upper edge of the inner wall, the titanium screen having electrical contact with the copper nuggets. During the deplating of the cylinder, the copper will be plated off from the cylinder onto the titanium screens and the copper nuggets in the baskets. Changing of the cycle back to replating the cylinder, the copper will be plated off from the titanium screens and also off of the nuggets in the baskets.

As the nuggets erode, fresh, large nuggets are dumped into the tops of the baskets so as to keep the baskets full. The eroded nuggets migrate towards the bottom of the baskets resulting in larger pieces of nuggets being in the top portions of the baskets and smaller pieces present in the bottom portions of the baskets.

To prevent copper from building up in the perforations through the inner walls of the nugget-containing baskets and forming "trees," i.e., rough copper growths so extensive as to extend into the space between the inner walls of the baskets and the cylinder, even to the cylinder itself, thereby short circuiting to the cylinder, a porous plastic sheet is disposed over the lower portion of the inner surface of each of the inner walls of the baskets. This has been found to completely eliminate the "tree" problem, and the plastic sheet also protects the titanium screen from spot contact with the copper pieces resulting in burn-out.

Figure 2:
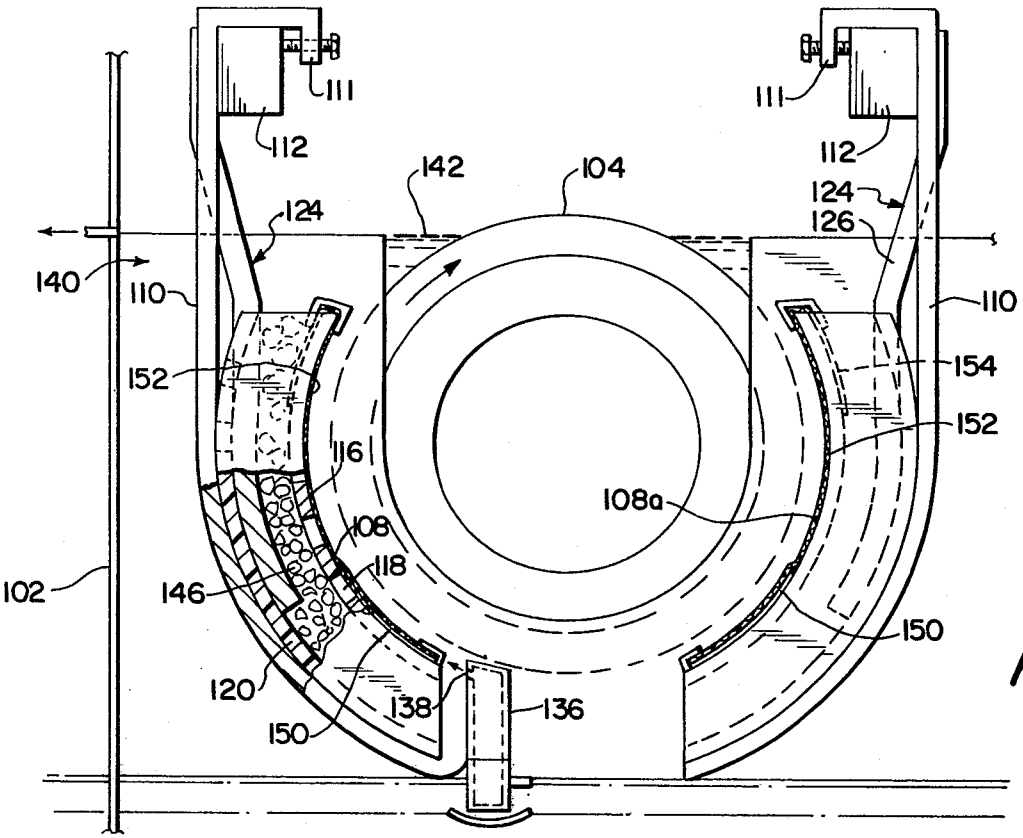

These and other objects will be apparent from the following specification and drawings, in which FIG. 1 is a fragmentary perspective view of the baskets, with the cylinder removed;

FIG. 2 is an end elevation, partly broken away showing the baskets and their mountings;

Referring now to the drawings in which like reference numerals denote similar elements, the plating apparatus includes a tank 102. A cylinder 104 to be plated is rotatably supported at its ends by bearings 106, in which it is rotatably driven by a suitable power device, not shown. Since the tank and cylinder mounting and drive are conventional, they are not detailed. On each side of the cylinder are disposed concavo-convex baskets 108 and **108*a* of polypropylene whose concave walls are disposed towards the cylinder. The baskets are suspended by hanger bars 110 attached as at 111 to current-carrying rails 112. The ends of the rails are conventionally supported by the tank ends. The inner walls 116 of the baskets have perforations 118 and the outer walls 120 of the baskets are blind, except for two rows of holes near their tops which permit plating solution to flow through. Suspended within the baskets and against the inner sides of outer walls are lead anodes 124 which consist of curved flat strips 126 attached as at 128 to the anode rail. The upper portions of the lead anode strips 126 are coated to protect them from the electrolyte and the lower portions are bare and in intimate contact with the copper nuggets 146. Mounted along the lower inner wall of basket 108 is a manifold 136, which is less than 180° away from the top of the cylinder and which is provided with jet outlets 138 which inject electrolyte 140 between the basket and cylinder and in the direction of basket rotation. Electrolyte 140** consisting of 220–250 g/liter copper sulphate and 60 g/liter sulfuric acid fills the tank to a level 142. High phosphor copper mini-nuggets 146, preferably 0.04 to 0.06 percent phosphor, are used.

In operation, the packing of the copper nuggets around the lead anode strips and between the lead anode strips and the cylinder being plated protects the lead anode strips against wearout. To ensure complete and constant exchange of the electrolyte, the tops of the baskets must always be below the top of the cylinder; otherwise, the baskets dam up the electrolyte and cause it to stagnate between the baskets and the cylinder and to overheat. The top of the cylinder should be above the level of the electrolyte so as to produce a washing action as the surface of the cylinder leaves and enters the electrolyte. Without these precautions the cylinder plating is rough.

The invention described in the foregoing specification is that of my co-pending application, Ser. No. 211,562, filed Dec. 1, 1980 (supra), and it has proved to be highly successful insofar as concerns plating copper from the cylinder onto nuggets. However, when the cylinder was de-plated, copper "trees" formed in the perforations through the inner walls of the plastic baskets. To prevent this, a sheet of porous plastic was secured over the entire length and width of the inner sides of the inner basket walls 116, and in order to cause the de-plated copper to plate onto as much surface as possible of the copper nuggets, the front walls of the baskets are perforated with large elongate holes.

A suitable porous plastic for this purpose is VYON, of a thickness of from 1/32" to 3/16", a material manufactured by Porvair, Ltd. of Norfolk, England. This material has a particle retention in the range of 25 microns and larger. It has the typical excellent chemical resistance of high density polyethylene and is tough, flexible and resilient so as to conform closely against the inner walls of the baskets.

For plating on the cylinder, the rails 112 are connected to the anode side of a plating current power supply and the cylinder 104 is conventionally connected to the other, cathode side of the power supply. For de-plating, the connections are reversed.

The aforementioned improvement was described in my second co-pending application, Ser. No. 255,281, filed Apr. 17, 1981 (supra).

This invention relates to the following additional feature which is a further improvement on the prior inventions:

A titanium screen 152 is secured over the inner wall of each of the plastic baskets 108 with the upper end 154 of the titanium screen 152 overlapping the upper edge of the inner wall 116 and being in electrical contact with the copper nuggets 146.

A porous plastic sheet 150 covers the lower portion of each of the inner basket walls 116 approximately one-third of the way up to prevent copper trees from forming from the smaller copper nuggets. As the nuggets work their way down towards the bottoms of the baskets, they erode to greatly reduced size. They then may escape the baskets and form "hot spots" on the titanium screen and cause it to burn out at localized areas. The porous plastic sheets prevent these small nuggets or pieces of nuggets from escaping from the baskets.

In operation during the deplating cycle the copper is deplated from the cylinder and onto the titanium screens and the copper nuggets. When the cylinder is plated again, the copper plates off of the titanium screens and also the copper nuggets in the baskets. Smaller pieces of copper nuggets and spent copper nuggets filter down to the bottom of the baskets and the plastic sheets covering the lower portion of the basket walls prevents burn-out on the titanium screens and copper trees from forming through the perforations in the baskets.

I claim:

1. Apparatus for electrolytic plating and de-plating of rotogravure cylinders, comprising a tank adapted to contain a plating solution and including means for supporting therein a cylinder for rotation about a horizontal axis in one direction, baskets disposed in said tank, one on each side of the cylinder, with inner concavo-convex arcuate perforate walls closely spaced from and concentric with the cylinder and outer walls spaced from the inner walls in the direction away from the cylinder, said baskets being of non-conducting plastic material, elongate metallic current conductor strips having upper protectively coated portions disposed above the baskets, and lower bare portions extending downwardly along inner sides of the outer basket walls, means for connecting a source of current to the upper portions of the conductor strips, nuggets of metal packed in said baskets between the lower portions of said conductor strips and the inner walls of the baskets, metallic screens disposed between the inner basket walls and cylinder and in electric connection with the metallic current conductor strips, a sheet of porous plastic material disposed between the lower portion of the concave side of each of the inner basket walls and the cylinder, and supply means for plating solution including a supply conduit having jet outlets disposed along a lower portion of the inner wall of at least one of the baksets for injecting plating solution between the porous plastic sheet and said cylinder.

2. Apparatus as claimed in claim 1, wherein the upper edge of the metallic screen overlaps the upper edge of the inner basket wall and is in electrical contact with the nuggets of metal.

3. Apparatus as claimed in claim 2, wherein said metallic screen is composed of titanium.

4. Apparatus for electrolytic plating and de-plating of rotogravure cylinders, comprising a tank adapted to contain a plating solution and including means for supporting therein a cylinder for rotation about a horizontal axis in one direction, baskets disposed in said tank, one on each side of the cylinder, with concavo-convex arcuate inner perforate walls closely spaced from the cylinder and outer concavo-convex arcuate walls concentric with and spaced from the inner walls in the direction away from the cylinder, said baskets being of non-conductive material, elongate metallic current-conductor strips, having upper protectively coated portions disposed above the baskets, and lower bare portions extending downwardly along inner sides of the outer basket walls, said lower portions being arcuate and concentric with the cylinder, means for connecting a source of current to the upper portions of the conductor strips and to the cylinder, nuggets of metal packed in said baskets between the lower portions of said conductor strips and the inner walls of the baskets, said baskets having tops disposed below the top of the cylinder, and supply and return means for maintaining plating solution in the tank with the level thereof below the top of the cylinder and above the tops of the baskets, metallic screens disposed between the inner basket walls and cylinder and in electrical connection with the metallic current conductor strips, means for preventing build-up of metal through the perforations of the inner basket walls comprising a sheet of porous plastic material covering each of the lower portions of the concave sides of the inner basket walls and disposed between the inner basket walls and the cylinder.

5. Apparatus as claimed in claim 4, the supply means for the plating solution including a supply conduit having jet outlets disposed along a lower portion of the inner wall of one of the baskets for injecting plating solution between the porous plastic sheet and said cylinder.

6. A basket assembly for electroplating and de-plating cylinders, comprising a basket adapted to be packed with nuggets of metal and being of non-conductive material and comprised of spaced concavo-convex front and rear walls, the front wall being perforate, said basket being adapted to be suspended in a plating solution with the concave side of the front wall disposed towards the cylinder to be plated, a plurality of elongate current-conductor bars having upper protectively coated portions extending upwardly from said basket and lower bare portions extending downwardly in said basket along the inner side of the rear wall thereof and being spaced from the inner side of the front wall thereof, means for connecting the upper portions of said conductor bars and the cylinder to opposite sides of an electrical current supply circuit, said basket walls and the lower base portions of said bars being curved along arcs of concentric circles, a metallic screen covering the concave side of the inner basket wall between the basket wall and the cylinder with the upper edge of the screen overlapping the upper edge of the inner basket wall and being in electrical contact with the nuggets of metal, and a sheet of porous plastic material disposed between the lower portion of the concave side of the front wall of the basket assembly and the cylinder, said porous plastic being of high density polyethylene having a particle retention of about 25 microns and larger.

7. Apparatus for electrolytic plating and de-plating of rotogravure cylinders, as claimed in claim 1, said porous plastic sheets being disposed between the inner walls of the baskets and the metallic screens.

* * * * *